United States Patent [19]

Huber

[11] Patent Number: 4,582,597

[45] Date of Patent: Apr. 15, 1986

[54] VIBRATORY SCREEN SEPARATOR

[75] Inventor: Gene A. Huber, Seal Beach, Calif.

[73] Assignee: Sweco, Incorporated, Los Angeles, Calif.

[21] Appl. No.: 596,621

[22] Filed: Apr. 4, 1984

[51] Int. Cl.[4] ..... B07B 1/48

[52] U.S. Cl. ..... 204/313; 209/403; 209/405

[58] Field of Search ..... 209/313, 401–405, 209/399, 395; 69/19.3; 101/127.1, 128.1

[56] References Cited

U.S. PATENT DOCUMENTS

| | | | |
|---|---|---|---|
| 2,279,042 | 4/1942 | Harrington | 209/403 |
| 3,176,843 | 4/1965 | Hoskin et al. | 209/403 |
| 4,082,657 | 4/1978 | Gage | 209/405 |
| 4,357,869 | 11/1982 | Wadstein | 69/19.3 |

FOREIGN PATENT DOCUMENTS

| | | | |
|---|---|---|---|
| 1186310 | 1/1965 | Fed. Rep. of Germany | 209/403 |
| 139667 | 1/1961 | U.S.S.R. | 101/127.1 |

*Primary Examiner*—Frank W. Lutter
*Assistant Examiner*—William Bond
*Attorney, Agent, or Firm*—Lyon & Lyon

[57] ABSTRACT

A vibratory screen structure which is rectangular in plan employing pretensioned screen panels and a pneumatic tube seal beneath the panels. Restraining members are positioned on two sides of the screen panels to hold the screen frames in position on the pneumatic tubes when sealed. The remaining sides are unrestrained and bow under the pressure of the pneumatic tubes to create a crown in each screen panel.

5 Claims, 8 Drawing Figures

VIBRATORY SCREEN SEPARATOR

BACKGROUND OF THE INVENTION

The field of the present invention is separators employing vibratory screens.

Vibratory screen systems have long been employed for the separation of solids suspended in liquid as well as solids of various sizes. The screens are generally drawn taut, oriented in a roughly horizontal position and vibrated in such a way that material will move advantageously across the screen during the screening process. Such vibratory structures are often characterized as either being rectangular or circular, each exhibiting its own advantages, motions design features and difficulties.

Two difficulties encountered with rectangular screens have been screen sealing and the avoidance of whipping. Screen sealing is necessary to prevent bypass, a condition where material on the screen is able to pass around the frame to again comtaminate the already screened material. Whipping is a condition where the center, unsupported area of the screen is able to vibrate at a greater amplitude than the frame. This may result from a transitory or continuous condition of partial resonance. Such a condition is disadvantageous because the material on the screen does not experience sufficient residence time for proper screening. Additionally, the material is not efficiently transported across the screen under such conditions and blinding from oversize material can occur.

The foregoing problems of bypass and screen whipping are brought to the fore because solutions to each of these problems in a rectangular screen have been mutually exclusive to any satisfactory degree. To effect proper sealing, prefabricated and pretensioned screen assemblies have been found most useful. The rigid frame structure may be easily pressed against a seal about all sides to eliminate bypass. Such rigid screen assemblies have found additional advantage through the use of known inflatable pneumatic tubes employed as the sealing mechanism. Through controlled deflation of the tubes, a sreen structure may be easily placed or removed. Inflation of the seal then properly locks and seals the screen in position. However, in large rectangular screening mechanisms whipping becomes a problem for such pretensioned screen structures regardless of the sealing mechanism. Because of the difficulties of tensioning and fabrication, structural bowing of the screen and the like (a known aid against whipping) has not been found practical.

To solve the whipping of large rectangular screens, stationary stays have been introduced into the vibratory frame which are bowed or crowned. Such a construction has required post tensioning of the screen which is laid over the frame and then pulled tight on two sides. This mechanism may substantially eliminate whipping but provides a less than satisfactory seal about the edge of the screen. With certain products such as thin coating material, any oversized particles bypassed to the final product cannot be tolerated.

SUMMARY OF THE INVENTION

The present invention is directed to a vibratory screen separator providing both effective sealing capability and a crowned structure for reduced whipping. A pretensioned screen with a rigid screen frame may be employed in conjunction with advantageous pneumatic seals. The separator is arranged with opposed restraining members on two sides of the screen area such that the screen spanning the restraining members may bow upwardly under the pneumatic pressure of the sealing mechanism. As a result, pneumatic sealing of a pretensioned, rigid frame screen structure may be employed with a crown for reduced whipping.

Accordingly, it is an object of the present invention to provide an improved vibratory screen structure having effective sealing capabilities and reduced whipping. Other and further objects and advantages will appear hereinafter.

DETAILED DESCRIPTION OF THE PREFERRED EMBODIMENT

Figure 1:
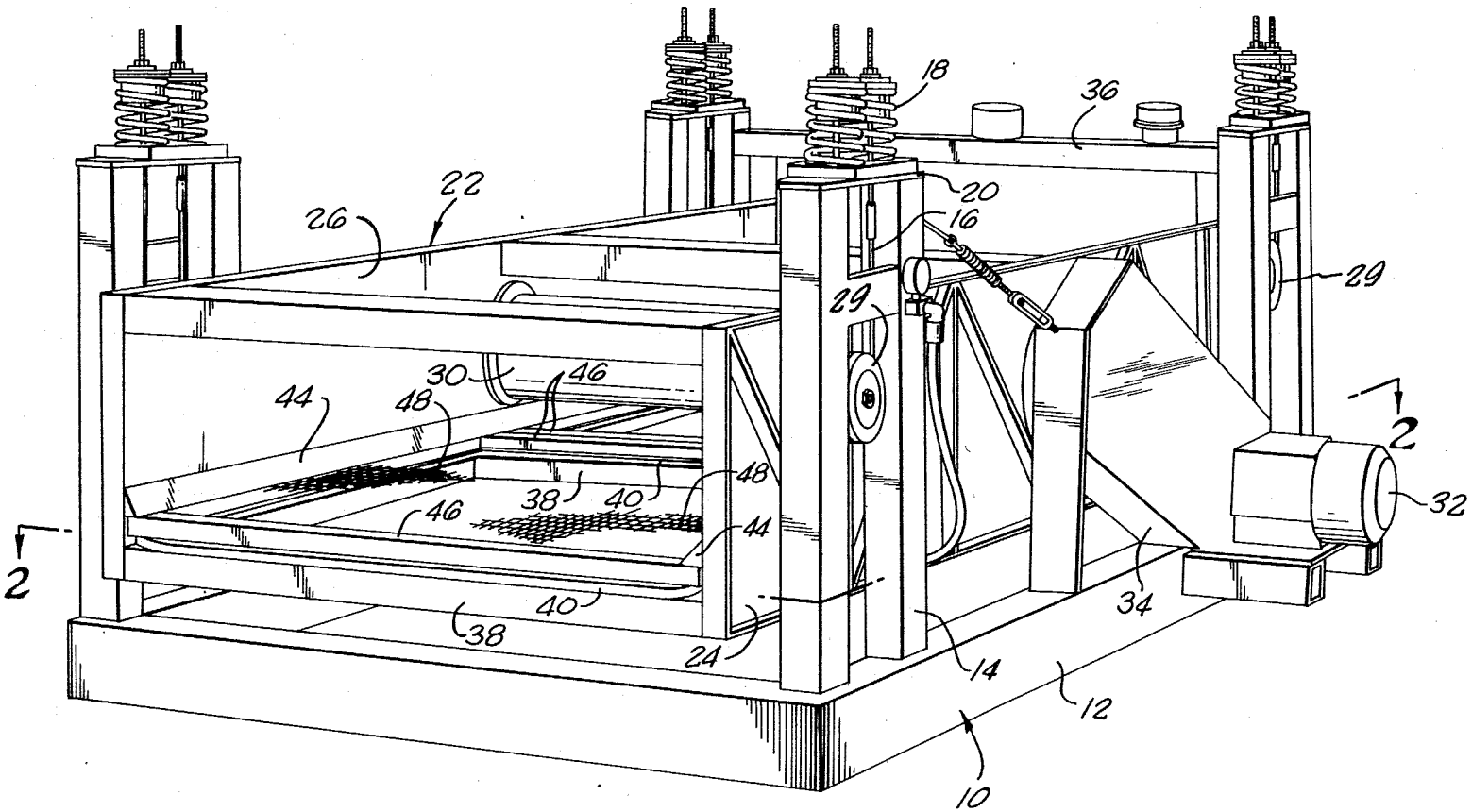
FIG. 1 is an oblique view of a vibratory screen separator.

Turning in detail to the drawings, FIG. 1 illustrates a vibratory screen separator. The separator includes a supporting structure, generally designated 10 which includes a rectangular base 12 with upstanding double columns 14 at each corner. Mounted on each double column 14 is a flexible support mechanism including a downwardly extending cable loop 16 attached at each end through a coil spring 18. The coil springs are mounted on cross members 20 extending between the double columns 14.

Positioned within the support structure 10 is a vibratory housing, generally designated 22. The housing 22 is rectangular in plan and has sidewalls 24 and 26 and an end wall 28, all of a convenient height for the processing for which the machine is designed. The final end wall is open for discharge of material separated by the screens. The entire vibratory housing 22 is mounted resiliently to the supporting structure 10 by wheels 29 positioned in the cable loops 16.

Associated with the vibratory housing 22 is a transverse tube 30 which encloses the rotary mounted vibratory weights which may be of conventional design. These weights are driven by a drive motor 32 fixed to the supporting structure 10, power being directed through a chain or belt located within a housing 34. A distributor 36 provides conditioned flow across the width of the vibratory housing 22 adjacent the end wall 28 downwardly into the screen area.

The vibratory housing 22 does not have a bottom but instead provides a plurality of rectangular frames 38. There are three rectangular frames illustrated in this embodiment which lie in a plane and are arranged side-by-side. These rectangular frames may be formed by four cross members, equally spaced across the housing 22, including one at each end. These rectangular frames 38 incorporate the sidewalls 24 and 26 running the length of the vibratory housing 22 on each side. As the result, three rectangular supports of equal plan are defined with open areas centrally through each support for material flow.

Figure 2:
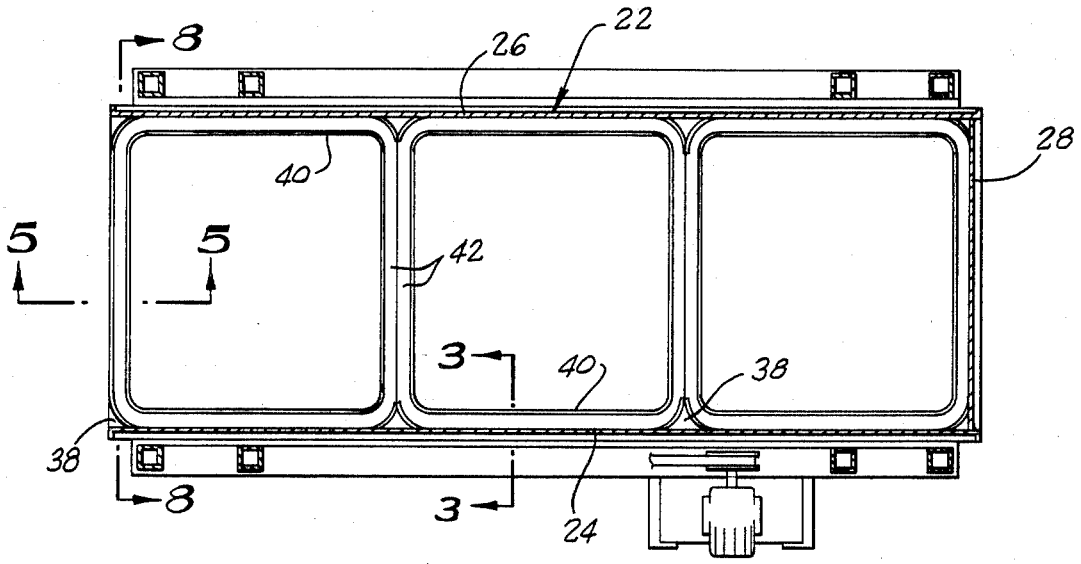
FIG. 2 is a plan view of the separator illustrated in cross section taken along line 2—2 of FIG. 1.
Figure 7:
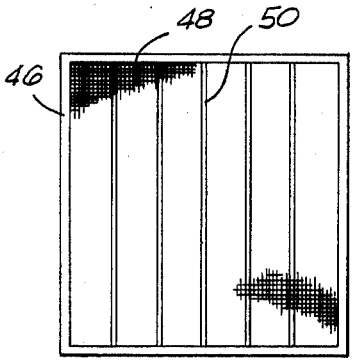
FIG. 7 is a plan view of a screen frame which may be employed with the present invention.

Located on each of the rectangular frames 38 is a pneumatic seal. The pneumatic seal is best illustrated in plan on FIG. 2 and in cross section in FIGS. 3–6. Each pneumatic seal includes a channel 40 positioned to the rectangular frame 38 and opening upwardly. The channel 40 may be conveniently fabricated of either channel material or simple upstanding flanges. Where sidewalls are available, the sidewalls themselves may form one side of the channel. Additionally, where two seals are in juxtaposition, the sidewall may be eliminated between the seals. As can be seen from the cross sections of FIGS. 3–6, the channel 40 adjacent the sidewalls 24 and 26 includes a simple angle extending inwardly from the sidewalls and upwardly to complete the channel configuration. Across the open end of the vibratory housing 22, a full channel member may be employed. At the corners of adjacent rectangular frames 38, curved flanges may extend to and be terminated at a common tangent with the seals extending as one double width channel between corners.

Figure 3:
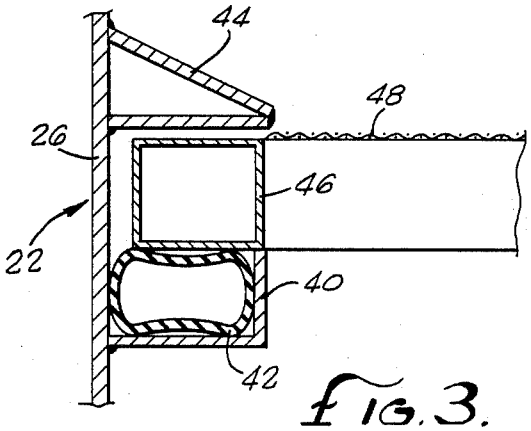
FIG. 3 is a cross-sectional detail taken along line 3—3 of FIG. 2 with the pneumatic seal deflated.
Figure 4:
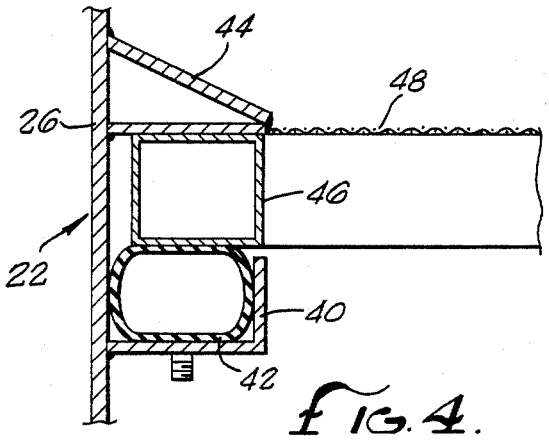
FIG. 4 is a cross-sectional detail taken along line 3—3 of FIG. 2 with the pneumatic seal inflated.
Figure 5:
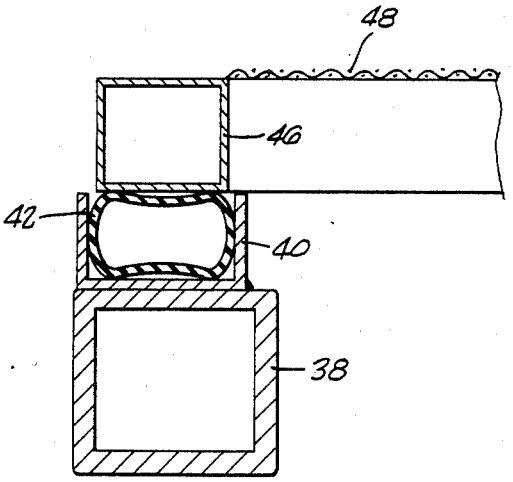
FIG. 5 is a cross-sectional detail taken along line 5—5 of FIG. 2 with the pneumatic seal deflated.
Figure 6:
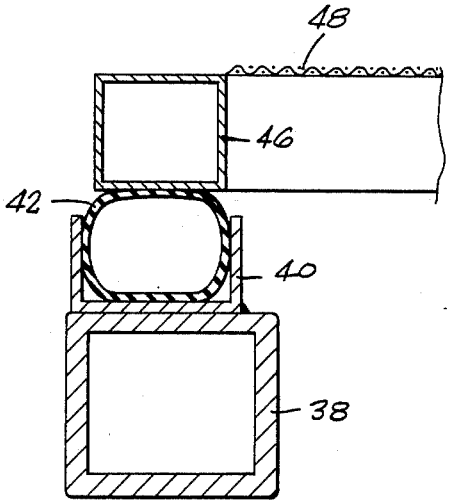
FIG. 6 is a cross-sectional detail taken along line 5—5 of FIG. 2 with the pneumatic seal inflated.

Located within the channel sections of the rectangular frames 38 are pneumatic tubes 42. Such pneumatic tubes are commercially available for sealing purposes and are designed to be constrained within channels such that when inflated they expand in a predictable direction to seal against a rigid surface. Pneumatic controls to direct pressurized air to each of the three pneumatic tubes 42 may also be conventionally arranged. FIGS. 3 and 5 illustrate the pneumatic tubes 42 in the deflated condition while FIGS. 4 and 6 illustrate the tubes in the inflated condition.

A restraining member 44 is located along each sidewall 24 and 26 of the vibratory housing 22. Each restraining member is placed above and spaced from a channel 40 along the sidewalls as can best be seen in FIGS. 3 and 4. The restraining members 44 thus hold a screen frame in position as will be discussed below. The restraining members 44 run the full length of each of the sidewalls 24 and 26 but do not run along the end wall 28, the open end opposite the end wall 28 or at any intermediate span parallel to the end wall 28.

Three screen panels are illustrated with the vibratory screen separator. The screen panels include screen frames 46 and screen cloth 48. The screen panels may be made according to existing techniques involving the pretensioning of the screen cloth 48 and the embedding or attaching of the tensioned screen cloth 48 to the screen frame 46. The frames 46 are substantially rigid in construction to maintain the tensioning within the screen cloth. These frames 46 are sized to fit on the rectangular frames 38 such that the pneumatic seal may effectively seal the frames upon installation. Ribs 50 are illustrated as extending in one direction at uniform spaces across each screen. These ribs 50 are parallel to the sides of the screen frames 46 which are positioned adjacent the restraining members 44. Thus, screen support is established across the screen without inhibiting the bending modulus of the structure in a direction perpendicular to the ribs.

Returning to the cross sections of FIGS. 3–6, the screen frames 46, the channels 40 and the restraining members 44 are arranged such that the screen frames 46 can slide without resistance between the restraining members 44 and the channels 40 with the pneumatic tubes 42 in the deflated condition. This easily positioned yet positively sealed arrangement is highly advantageous for processing plants where continuous operation is implemented. Very rapid and accurate screen replacement may be accomplished whenever a screen may become worn or otherwise inoperative.

Figure 8:
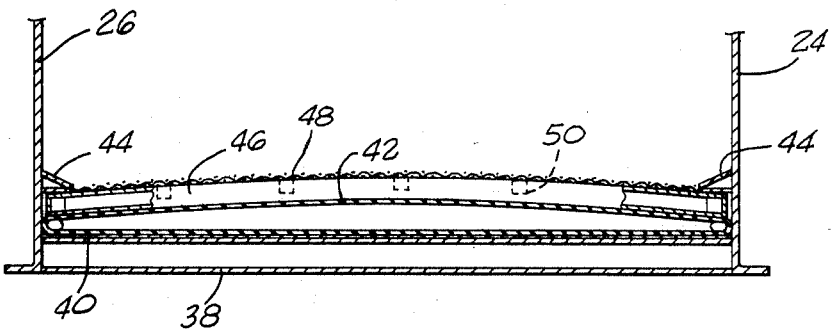
FIG. 8 is a cross-sectional end view of the separator illustrated with the pneumatic seal inflated, taken along line 8—8 of FIG. 2.

The foregoing arrangement is found to be very advantageous because of the unrestricted span of the screen panels between the restraining members 44. As can best be seen in FIG. 8, the pneumatic tubes 42 exert substantial pressure on the screen frame in an upwardly direction along the full length of the frame. As a result, some bowing of the frame between restraining members 44 is induced. This establishes a crown to the screen which cannot be easily fabricated into the prestressed screen panel. This bowing of the screen acts to substantially reduce any whipping action experienced by the screen during vibratory motion. The bowing need not be very great to accomplish the foregoing result. A maximum of one-half inch vertical displacement across a span of 46 inches is considered more than sufficient.

Thus, a vibratory screen separator has been disclosed which provides highly efficient screening and sealing of materials thereon. Efficiency is increased through a reduction in screen whipping even though a prestressed screen panel is employed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A vibratory screen separator comprising a vibratory rectangular housing having at least four frame members arranged to define a rectangular frame having a first side;

a pneumatic seal on said first side of said rectangular frame coextensive with and aligned along each of said frame members;

restraining members positioned adjacent said frame first side and being coextensive with two transversly opposed said frame members; and a screen panel having a screen frame flexible relative to said frame members, said screen frame being positioned between said pneumatic seal and said restraining members, said screen frame being restrained above said pneumatic seal only along said opposed frame members such that, upon inflation of said pneumatic seal, said screen panel will exhibit flexure with a seal formed between said rectangular frame and said screen frame.

2. The vibratory screen separator of claim 1, wherein said restraining members include inwardly extending flanges coextensive with said two opposed frame members.

3. The vibratory screen separator of claim 1 wherein said pneumatic seal includes a pneumatic tube and a channel about said tube, said channel being affixed to said frame and being open upwardly.

4. The vibratory screen separator of claim 1 further comprising a plurality of said vibratory rectangular frames lying in a plane side-by-side thereby forming a rectangle with four sides and a plurality of pneumatic seals on said rectangular frames, said restraining members extending along two opposed sides of said rectangle formed by said plurality of rectangular frames.

5. A vibratory screen separator comprising a vibratory rectangular housing having at least four frame members arranged to define a rectangular frame having a first side;

a pneumatic seal on said first side of said rectangular frame coextensive with and aligned along each of said frame members and including means forming a channel opening upwardly from said first side of said rectangular frame and a pneumatic tube positioned in said channel;

restraining members aligned adjacent said pneumatic seal along two transversely opposed frame members of said rectangular frame; and a screen panel having a screen frame flexible relative to said frame members, said screen frame being positioned between said pneumatic seal and said restraining members such that, upon inflation of said pneumatic seal, said screen panel will exhibit flexure with a seal formed between said rectangular frame and said screen frame.

* * * * *